US006874224B2

(12) United States Patent
Ahuja et al.

(10) Patent No.: US 6,874,224 B2
(45) Date of Patent: Apr. 5, 2005

(54) METHOD FOR MANUFACTURING A MULTI-SITE SPARE THREE-PHASE TRANSFORMER

(75) Inventors: Rajendra Ahuja, Fremont, CA (US); Joseph Nguyen, San Jose, CA (US); Mostafa Jafarnia, Fremont, CA (US)

(73) Assignee: Waukesha Electric Systems, Inc., Waukesha, WI (US)

( * ) Notice: Subject to any disclaimer, the term of this patent is extended or adjusted under 35 U.S.C. 154(b) by 114 days.

(21) Appl. No.: 10/175,888

(22) Filed: Jun. 21, 2002

(65) Prior Publication Data

US 2003/0234639 A1 Dec. 25, 2003

(51) Int. Cl.[7] ..... H01F 7/06

(52) U.S. Cl. ..... 29/606; 29/602.1; 29/832; 29/854; 338/12

(58) Field of Search ..... 29/596–598, 602.1–607, 29/832, 842, 854; 336/5, 12; 361/35

(56) References Cited

U.S. PATENT DOCUMENTS 3,676,766 A * 7/1972 Blackmond ..... 323/239
4,611,190 A * 9/1986 Montague ..... 336/10
5,014,153 A * 5/1991 Wilkerson ..... 361/36

* cited by examiner

*Primary Examiner*—A. Dexter Tugbang
*Assistant Examiner*—Donghai D. Nguyen
(74) *Attorney, Agent, or Firm*—Baker & Hostetler LLP

(57) ABSTRACT

A three phase transformer circuit is provided that includes a supply side, wherein the supply side is selectably configurable, via the use of se of terminal boards, between a delta connection and a wye connection at a time of use and, a load side, wherein the load side is selectably configurable between a delta connection and a wye connection at the time of use. The three-phase transformer also provides for selecting an input voltage, from multiple input voltages, via the sets of terminal boards, at the time of use, and for selecting an output voltage for the supply side, from multiple output voltage, at the time of use.

4 Claims, 2 Drawing Sheets

METHOD FOR MANUFACTURING A MULTI-SITE SPARE THREE-PHASE TRANSFORMER

FIELD OF THE INVENTION

The present invention relates generally to a transformer. More particularly, the present invention is directed to circuitry of a three-phase power transformer that is configurable to accommodate a delta or a wye connection on a supply and a load side of the transformer. Further, the present invention is directed to a three-phase transformer that can step up or step down the supply voltage to a user-selectable amount.

BACKGROUND OF THE INVENTION

Most electricity is produced at a power plant. When the electricity leaves the power plant, it is sent over high power transmission lines. Because electricity loses some of its strength, i.e., voltage, as it travels, it may be helped along to its destination by a transformer which will increase (i.e., step up) the voltage that it receives.

When the electricity gets closer to where it will be consumed, another transformer will be utilized to decrease (i.e., step down) the voltage that it receives before forwarding to a consumer.

Difficulty arises when a transformer at a substation along the distribution path from the power plant to the consumer breaks down. When a failure occurs a replacement/spare transformer is utilized to restore power. However, the replacement transformer has to meet the design requirements of the substation in need.

A transformer is typically designed to accommodate the layout of a particular substation. The layout from one substation to another will vary according to the electrical connections required to connect the transformer to a supply and a load. The electrical connections to the supply and the load may be via a delta connection or a wye connection. Accordingly, there are four connection configuration combinations i.e., a delta-delta, a wye-wye, a delta-wye, or a wye-delta that a substation in need could require to connect the transformer to a supply and, respectively a load.

Whether a transformer operates as a step up transformer or a step down transformer may also vary from one substation to another, and thus, the output voltage required from a transformer may also vary from one substation to another. Transformers have been developed to accommodate various supply and load connection configurations or various output voltage requirements. However, a transformer that has circuitry that allows a user flexibility in selecting both the supply and load connection configurations and the desired output voltage is desirable.

Because of the various possible supply and load connection configurations, and the various possible output voltages that a substation may require, it is costly for an electric company to maintain a replacement transformer for every possible transformer configuration. Typically, electric companies maintain transformers in inventory for utilization as replacement transformers. However, a transformer design is often unique, and thus, a transformer may not be available that is compatible with the specific requirements of the substation in need. As a result, a power outage is often extended until a suitable replacement is found.

Accordingly, there is a need for a spare transformer that is user-configurable to accommodate four supply and load connection configurations, and multiple output voltages.

SUMMARY OF THE INVENTION

In an aspect of the present invention, a three-phase transformer circuit is provided that includes a supply side, wherein the supply side is selectably configurable between a delta connection and a wye connection at a time of use; a load side, wherein the load side is selectably configurable between a delta connection and a wye connection at the time of use, and wherein an output voltage from the supply side is user-selectable, from multiple output voltages, at the time of use.

In another aspect of the present invention, a three-phase transformer circuit is provided that includes a supply side, a means for selectably configuring the supply side between a delta connection and a wye connection at a time of use, a load side, a means for selectably configuring the load side between a delta connection and a wye connection at the time of use, and a means for selecting a voltage output, from multiple voltage outputs, at the time of use, wherein the voltage output is from the load side.

In yet another aspect of the present invention, a method for manufacturing a multi-site transformer is provided that includes dividing the circuitry into a supply side and a load side, connecting a winding start lead from each of three sets of supply windings, individually, to one of three supply terminal boards for connecting the three sets of windings in one of a delta and a wye configuration, dividing outer windings on the supply side into a top portion and a bottom portion, and connecting a start lead and a finish lead from both the top portion and the bottom portion to the supply terminal board for controlling a voltage output from the circuitry.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
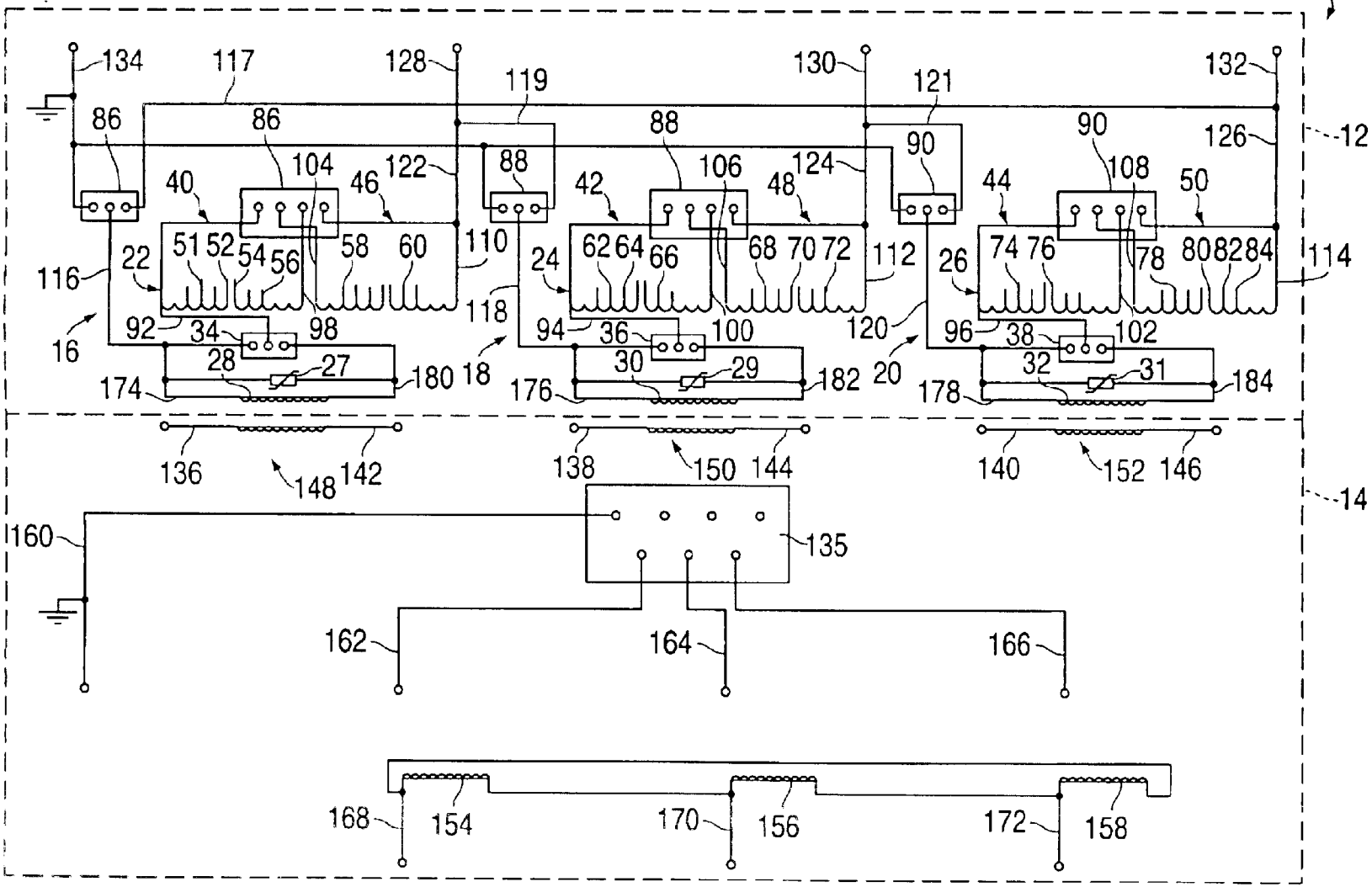
FIG. 1 is a schematic of the circuitry of a multi-site three-phase transformer in accordance with the present invention.

Referring now to FIG. 1, wherein like reference numerals indicate like elements, circuitry 10 of a multi-site three-phase transformer in accordance with the present invention is shown. In an exemplary embodiment of the present invention, the circuitry 10 is user-configurable to accommodate multiple output voltage requirements, and multiple delta-wye connection configuration combinations for connecting the circuitry 10 to a supply and to a load.

The circuitry 10 has a supply/input voltage side 12 and a load/output voltage side 14. The supply side 12 of the transformer has three supply set of windings 16, 18, 20. Each supply set of windings 16, 18, 20 has outer windings 22, 24, 26 and inner windings 28, 30, 32. Each of the inner windings 28, 30, 32 are optionally includable in the circuitry 10 via a start/inner winding terminal board 34, 36, 38. In an exemplary embodiment of the present invention a non-linear device 27, 29, 31 is connected across each of the inner windings 28, 30, 32 to protect the transformer circuitry 10 from charge that accommodates on the inner windings 28, 30, 32 during the time when the inner windings 28, 30, 32 are not included in the operation of the circuitry 10.

Each assembly of outer windings 22, 24, 26 is divided into a first portion 40, 42, 44 and a second portion 46, 48, 50 that can be connected to each other in series or in parallel. Tap leads 51–84 extend from the outer windings 22, 24, 26 and allow a user to select a portion of the outer windings 22, 24, 26, from zero to the maximum number of windings present, that will operate in the circuitry 10.

A supply terminal board 86, 88, 90 is provided at each supply set of windings 16, 18, 20. Individually, each supply terminal board 86, 88, 90 allows the start lead 92, 94, 96 and the finish lead 98, 100, 102 of each first portion 40, 42, 44 to be connected in series or in parallel with the start lead 104, 106, 108 and the finish lead 110, 112, 114 of each second portion 46, 48, 50.

Collectively, the terminal boards 86, 88, 90 are utilized to electrically connect the start leads 116, 118, 120 and finish leads 122, 124, 126 of each supply set of windings 16, 18, 20 in either a delta configuration or a wye configuration. In an exemplary embodiment of the present invention, supply connection leads 128, 130, 132 extend from the supply side 12 of the circuitry 10 to connect an incoming supply to the supply side 12 of the circuitry 10. It should be understood by one of ordinary skill in the art that the finish lead 110, 112, 114 of each second portion 46, 48, 50 may be formed continuously with the finish lead 122, 124, 126 of each supply set of windings 16, 18, 20 and/or the supply connection lead 128, 130, 132 of each supply set of windings 16, 18, 20.

Shown in FIG. 1, the start leads 116, 118, 120 and finish leads 122, 124, 126 of each supply set of windings 16, 18, 20 are electrically connected in a delta configuration. The start leads 116, 118, 120 each emanate from one of the supply terminal boards 86, 88, 90. Connections 117, 119 and 121 also emanate from the supply terminal boards 86, 88, 90 and, in an exemplary embodiment of the present invention, are utilized to connect the three sets of windings 16, 18, 20 in the delta configuration shown in FIG. 1.

It should be understood by one of ordinary skill in the art, that three connections are made between the first, second, and third set of windings to form a delta configuration. The connections between the windings are as follows: the start lead of the first set of windings is connected to the finish lead of the third set of windings, the finish lead of the first set of windings is connected to the start lead of the second set of windings, and the finish lead of the second set of windings is connected to the start lead of the third set of windings.

The connections between the windings 16, 18, 20 to form a delta configuration are as follows: the start lead 116 of the first set of windings 16 is connected to the finish lead 126 of the third set of windings 20 via connection 117; the finish lead 122 of the first set of windings 16 is connected to the start lead 118 of the second set of windings via connection 119; and the finish lead 124 of the second set of windings 18 is connected to the start lead 120 of the third set of windings 20 via connection 121.

It should be understood by one of ordinary skill in the art that to form a wye configuration the first, second and third sets of windings are connected to a neutral point.

To form the windings 16, 18, 20 in a wye configuration, start leads 116, 118, 120 of each supply set of windings 16, 18, 20 are connected, via an electrical connection, to the neutral line 134 on each terminal board 86, 88, 90.

In one embodiment of the present invention, the neutral line 134 is connected to ground. It should also be understood by one of ordinary skill in the art that the neutral line 134 is not necessary to electrically connect each supply set of windings 16, 18, 20 in a wye configuration.

On the load/output voltage 14 side of the circuitry 10, a first load terminal board 135 is utilized to connect the start leads 136, 138, 140 and finish leads 142, 144, 146 of a first set of load windings 148, 150, 152 in a delta configuration or a wye configuration for connection to a first load.

In an exemplary embodiment of the present invention start leads 136, 138, 140 are connected to the corresponding terminals 136', 138', 140' on the first load terminal board 135. The finish leads 142, 144, 146 are connected to the corresponding terminals 142', 144', 146' on the first load terminal board 135.

When it is desirable to form the first set of load windings 148, 150, 152 in a delta configuration, connections have to be made between the first, second and third sets of windings as defined above. Accordingly, a separate electrical conductor, such as a wire, is utilized to make an electrical between terminal 136' and terminal 146', terminal 142' and terminal 138', and terminal 144' and terminal 140'.

In another exemplary embodiment of the present invention, when it is desirable to form the first set of load windings 148, 150, 152 in a wye configuration, terminals 136', 138', 140' are each connected to neutral line 160. In an exemplary embodiment of the present invention, the neutral line 160 is connected to ground. It should be understood by one of ordinary skill in the art that the neutral line 160 is not essential to electrically connect the first set of load windings 148–152 in a wye configuration.

A substation may be designed to output a voltage to two loads. Thus, in an exemplary embodiment of the present invention, a second set of load windings 154, 156, 158 are provided to electrically connect the second set of load windings 154, 156, 158 to the second load in a delta configuration or a wye configuration.

Shown in FIG. 1, the second set of windings 154, 156, 158 is electrically connected in a delta configuration as described above, that is fixed. It should be understood by one of ordinary skill in the art that the second set of windings 154, 156, 158 may be connected wye configuration, as defined above, that is fixed. Load connection leads 162, 164, 166 extend from the first set of load windings 148, 150, 152 of the circuitry 10 to connect the first set of load windings, 148, 150, 152 for a load.

In an exemplary embodiment of the present invention, a second load terminal board may be provided that may be utilized, as the first load terminal board 135 is utilized, that allows the second set of load windings 154–158 to be connected in either a delta configuration or a wye configuration.

Load connection leads 168, 170, 172 extend from the second set of load windings 154, 156, 158 of the circuitry 10 to connect the second set of load windings 168, 170, 172 to a load.

The circuitry 10 in accordance with the present invention provides a user with the option to select a voltage, among multiple voltages, to be output from the circuitry 10. Accordingly, a user of circuitry 10 in accordance with the present invention can decide whether the circuitry 10 will be utilized to step up the voltage that the circuitry 10 receives or to step down the voltage that the circuitry 10 receives by controlling the number of windings that will be included during the operation of the circuitry 10.

A user of the circuitry 10 in accordance with the present invention selects an input voltage to be received by the supply side of the transformer from multiple input voltages, and controls the output voltage from the circuitry 10 by selectively including the inner windings 28, 30, 32, by selectively connecting the first portion 40, 42, 44 and the second portion 46, 48, 50 of each supply set of windings 16, 18, 20 in series or in parallel, and/or by selectively tapping into a the outer windings 22, 24, 26.

In an exemplary embodiment of the present invention shown in FIG. 1, start leads 174, 176, 178 and finish leads 180, 182, 184 of each of the inner windings 28, 30, 32 respectively terminate on the start/inner winding terminal boards 34, 36, 38. Each of the start leads 92, 94, 96 of the first portion 40, 42, 44 also terminate on the respective start/inner winding terminal board 34, 36, 38. Accordingly, each of the inner windings 28, 30, 32 can be electrically connected in series with the corresponding first portion 40, 42, 44, when selectively included in the operation of the circuitry 10. Because the start lead 116, 118, 120 of each supply set of windings 16, 18, 20 also terminates on the start/inner winding terminal board 34, 36, 38, an open circuit can be easily created between the start leads 174, 176, 178 and finish leads 180, 182, 184 of the inner windings 28, 30, 32 and the outer windings 22, 24, 26 to selectively exclude the inner windings 28, 30, 32 from operation in the circuitry 10.

Further, the start lead 116, 118, 120 of each supply set of windings 16, 18, 20 emanates from each of the inner winding terminal boards 34, 36, 38 independent of whether the inner windings 28, 30, 32 are included in the operation of the circuitry 10. Accordingly, the circuitry 10 does not have to be significantly disturbed when changing the status of the inner windings 28, 30, 32.

In the same or another exemplary embodiment of the circuitry 10 of the present invention, the start leads 92, 94, 96 and the finish leads 98, 100, 102 of each first portion 40, 42, 44 and the start leads 104, 106, 108 and the finish leads 110, 112, 114 of each second portion 46, 48, 50 terminate on each of the supply terminal boards 86, 88, 90. Accordingly, the voltage can be controlled by selectively connecting each first portion 40, 42, 44 in series or in parallel with each second portion 46, 48, 50. In an exemplary embodiment of circuitry 10 in accordance with the present invention, the supply terminal boards are utilized to selectively configure the three sets of supply windings 16, 18, 20 in a delta or a wye configuration, and to selectively vary the output voltage from the circuitry 10.

In the same or yet another exemplary embodiment of the circuitry 10 of the present invention, tap leads 51–84 are provided that allow a user to select how many of the outer windings 22, 24, 26 will be included during the operation of the circuitry 10. In an exemplary embodiment of the present invention, the tap leads 51–84 of each supply set of windings are connected to tap switches, such that when a tap switch is switched on, the voltage corresponding to the number of windings associated with the tap switch is included in the operation of the circuitry 10. Accordingly, the taps 51–84 provide flexibility in attaining the specific voltage step up or step down amount. It should be understood by one of ordinary skill in the art that the number of tap leads may vary.

The windings of the first and/or second set of load windings 148–158 on the load side 14 of the circuitry 10, in an exemplary embodiment of the present invention shown in FIG. 1 are fixed. The supply set of windings 16, 18, 20 induce voltage into the load set of windings. Accordingly, the amount of voltage output from the windings 148–158 of the load side 14 is controlled by the number of windings of the supply side 12 that are selected to be included into the operation of the circuitry 10. In an exemplary embodiment the present invention, the output voltage from the load side 14 is variable from 0 kilovolts (kV) to 338 kV.

In an exemplary embodiment of the present invention, any one of the terminal boards may be replaced by a switch. In an exemplary embodiment of the present invention, a delta-wye switch is utilized to selectably configure coil sets on the supply and/or load side of the transformer in either a delta or a wye configuration. In the same or another exemplary embodiment of the present invention, a voltage switch, for example a dual-voltage switch, is utilized to select a voltage that is to be, for example, output from a load side of the transformer.

It should be understood by one of ordinary skill in the art that the number of terminal boards of the present invention may vary.

Figure 2:
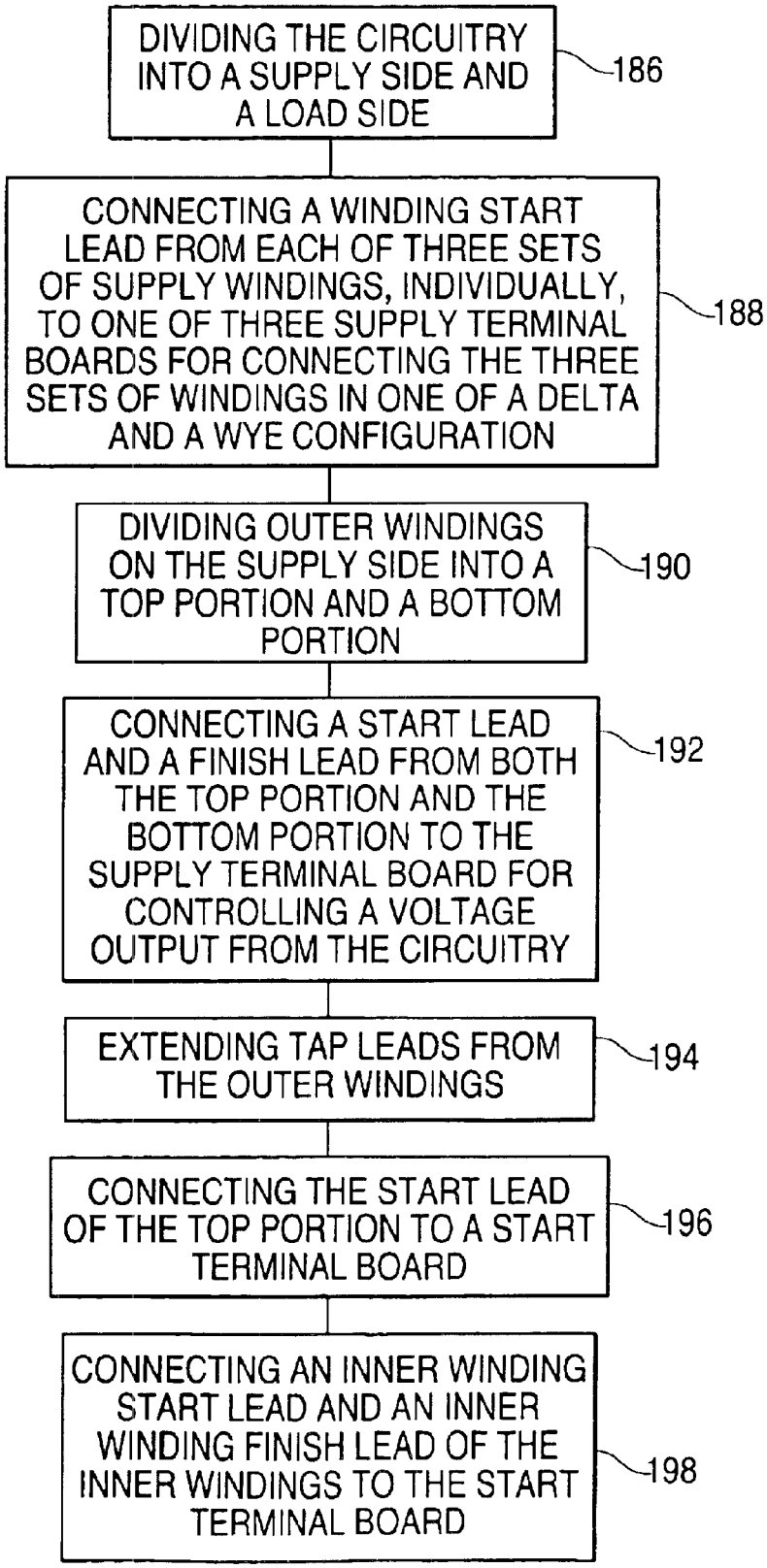
FIG. 2 is a flow chart of a method for manufacturing circuitry of a multi-site three phase transformer in accordance with the present invention.

FIG. 2 is a flow chart describing the steps of an exemplary method for manufacturing circuitry 10 of a multi-site three-phase transformer in accordance with the present invention. In step 186 the circuitry is divided into a supply side and a load side. A winding start lead from each of the three sets of supply windings are, individually, connected to one of three terminal boards for connecting the three sets of windings in one of a delta and a wye configuration 188. Outer windings on the supply side are divided into a top portion and a bottom portion 190. The start leads and finish leads from both the top portion and the bottom portion are connected to the supply terminal board for controlling a voltage output from the circuitry 192.

In an exemplary embodiment of the present invention, tap leads are extended from the outer windings 194. In the same or another exemplary embodiment of the present invention, the start lead of the top portion is connected to a start terminal board 196. In the same or yet another exemplary embodiment of the present invention, an inner winding start lead and an inner winding finish lead of the inner windings are connected to the start terminal board 198.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for manufacturing circuitry of a multi-site three-phase transformer, comprising the steps of:

dividing the circuitry into a supply side and a load side;

connecting a winding start lead from each of three sets of supply windings, individually, to a respective one of three sets of supply terminal boards for connecting the three sets of windings in one of a delta and a wye configuration;

dividing outer windings on the supply side into a top portion and a bottom portion; and connecting supply terminal board start leads and a finish lead from each of the top portion and the bottom portion, to the respective supply terminal board for controlling a voltage output from the circuitry.

2. The method of claim 1, further comprising extending tap leads from the outer windings.

3. The method of claim 1, further comprising connecting each of the start leads of the top portion to a start terminal board.

4. The method of claim 3, further comprising connecting a start lead and a finish lead of the inner windings to the start terminal board.

* * * * *

UNITED STATES PATENT AND TRADEMARK OFFICE

CERTIFICATE OF CORRECTION

PATENT NO. : 6,874,224 B2
DATED : April 5, 2005
INVENTOR(S) : Rajendra Ahuja et al.

It is certified that error appears in the above-identified patent and that said Letters Patent is hereby corrected as shown below:

Title page,
Item [57], ABSTRACT,
Line 3, please replace "se" with -- sets --.

Signed and Sealed this

Seventh Day of June, 2005

JON W. DUDAS
*Director of the United States Patent and Trademark Office*